US005123570A

United States Patent [19]

Dubow et al.

[11] Patent Number: 5,123,570

[45] Date of Patent: Jun. 23, 1992

[54] CONTAINER FOR INVERTED DISPENSING

[76] Inventors: Brian C. Dubow, 3505 W. Atlantic Blvd. Ste. 310, Pompano Beach, Fla. 33069; Andres Barcenas, 8801 SW. 23rd St., Miramir, Fla. 33025

[21] Appl. No.: 528,934

[22] Filed: May 25, 1990

[51] Int. Cl.[5] ..... B65D 3/26

[52] U.S. Cl. ..... 222/83; 222/213; 222/510; 222/541

[58] Field of Search ..... 222/81, 83, 213, 510, 222/541; 206/601, 603, 222; 215/257, 302, 247, 249, 32; 220/277; 221/30, 31; 141/329, 330

[56] References Cited

U.S. PATENT DOCUMENTS

| | | | |
|---|---|---|---|
| 550,315 | 11/1895 | Allen | 215/32 |
| 3,563,413 | 2/1971 | Gordon | 222/83.5 |
| 3,730,336 | 5/1973 | Feldman | 206/603 |
| 4,513,883 | 4/1985 | Melzi et al. | 222/510 |
| 4,637,934 | 1/1987 | White | 206/603 |
| 4,953,706 | 9/1990 | Piccard | 220/277 |
| 4,955,746 | 9/1990 | Craigmile | 222/510 |

*Primary Examiner*—Michael S. Huppert
*Assistant Examiner*—Philippe Derakshani
*Attorney, Agent, or Firm*—Malin, Haley, McHale, DiMaggio & Crosby

[57] ABSTRACT

A container for dispensing engine oil including a self-contained plunger with a cutting head that permits dispensing of the oil in an inverted position in cramped spaces. The container includes a foil or other frangible seal across the spout opening that is pierced by manual actuation of the plunger after the container is inverted. The container base includes a flexible area for pressing manually against the plunger end. The invention permits dispensing of oil into an engine without spillage in engine compartments having limited space for positioning the oil container.

6 Claims, 3 Drawing Sheets

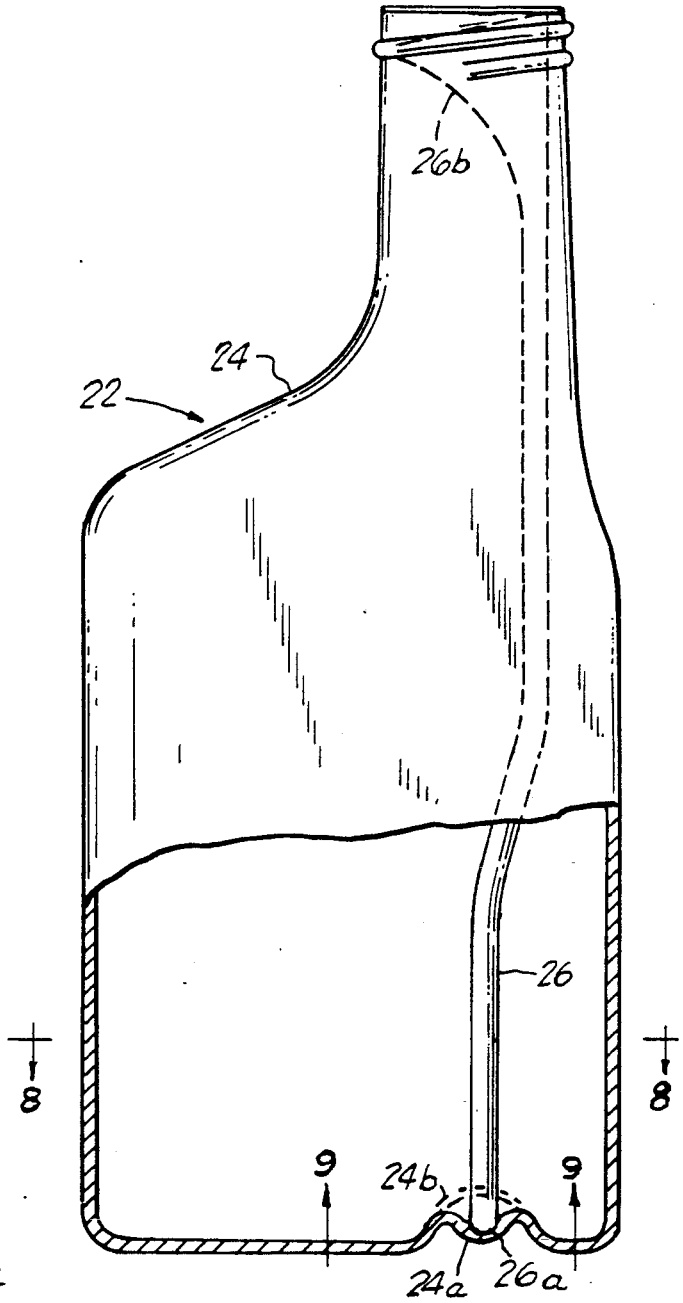
FIG. 7.
FIG. 9.
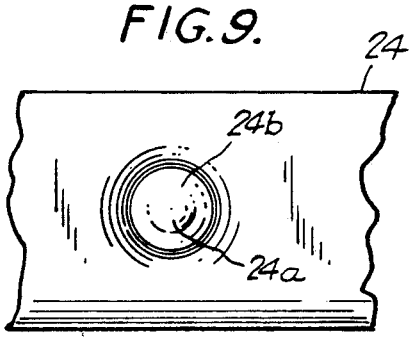
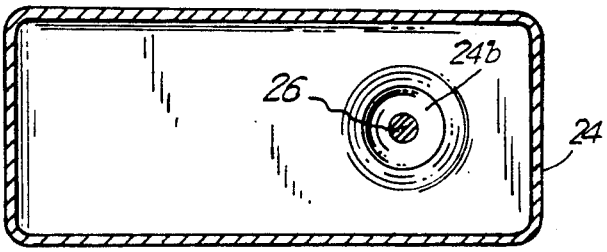
FIG. 8.

CONTAINER FOR INVERTED DISPENSING

BACKGROUND OF THE INVENTION

1. Field of the Invention

This invention relates to a liquid container from which the liquid contents can be dispensed without spillage with the container in an inverted position, and specifically to a container for combustion engine oil that can be used in very limited engine compartment spaces to dispense oil into the engine without spillage through the use of a manually actuated dispenser mounted within the container.

2. Description of the Prior Art

The use of small hand-held containers for dispensing liquids often involves aligning the spout of the container with an opening that is to receive the liquid and inverting the container to empty its contents. When dealing with combustion engines as are found in aircraft, boats or automobiles and other machines, oftentimes the engine opening for receiving a liquid such as oil is located in an inaccessible area without sufficient maneuvering space that makes pouring awkward or almost impossible without spillage. The end result is more often than not, spillage of the oil around the engine compartment while trying to pour the oil into the proper engine opening. Devices for facilitating emptying of an oil can container into an engine oil input have been shown in the prior art. For example, U.S. Pat. No. 4,497,351 issued to Garcia on Feb. 5, 1985 shows an apparatus for dispensing oil from an oil can which is used by penetrating the bottom of the oil can after the apparatus has been attached to the oil inlet. Such an apparatus requires sufficient engine compartment space to place the oil can over the cutting element and to forcibly rupture the can bottom which would be difficult in a cramped space. Likewise U.S. Pat. No. 4,289,255 issued to Strampe on Sept. 15, 1981 shows an oil filter cap which is mounted on the rocker cover in an internal combustion engine, which again requires sufficient space to maneuver the oil can over the can opening mechanism to sufficiently penetrate the can opening to empty the can.

The present device overcomes the problems of the prior art by providing a device that can be used for dispensing engine oil into an engine oil input which requires no more room than basically the length of the container itself and which can be actuated in an inverted position after the spout of the container has been placed within the engine oil inlet, eliminating any possibility of spillage.

SUMMARY OF THE INVENTION

A hand-held liquid container having a self-contained dispensing actuator that permits dispensing of the liquid therein to begin after the container has been rotated to an inverted position. The liquid container includes a hollow body, a spout, a frangible seal such as foil disposed over the spout opening, sealing the liquid contents therein, and a conventional threaded screw-type cap that is placed over the spout for storage and transit.

Inside the container is disposed a dispensing plunger having an elongated shaft that runs essentially the length of the container from the container base to near the upper rim of the spout, the plunger including a cutting head uniformly formed with one end of the shaft at a predetermined angle. The cutting head has a crescent-shaped body with a knife-edge upper surface forming an upper ridge on top of the crescent-shaped body and non-cutting retainers uniformly formed below the knife-edge extending in furtherance of the crescent-shape preventing the plunger from leaving the container after the frangible seal has been broken. In an alternate embodiment, the non-cutting retainers can be eliminated in that the plunger end tip is heat fused to the bottom floor of the container in an area having a movable recessed portion for activating the plunger.

The base wall or floor of the container in the area where the plunger shaft end tip resides (opposite end from the cutting head) includes, in one embodiment, a small aperture which permits a portion of the plunger shaft to be disposed therethrough, the container area housing the aperture being somewhat recessed from the plane of the container bottom. A flexible sealable sheet is attached over the recessed area so that the plunger end tip is completely housed in a compartment sealed from the outside environment. The flexible sealing sheet is thus substantially in engagement with the end tip of the plunger shaft which allows the shaft to be manually actuated by a finger causing the plunger cutting head to move toward and pierce the spout seal over the spout opening while the container is inverted. The cutting head pierces the frangible seal in substantially a crescent-shape so that a portion of the seal remains attached to the spout rim preventing the seal from falling into the engine oil input while allowing the oil to flow freely from the container in an inverted position. The retainers on the cutting head prevent the plunger from falling out of the container.

In an alternate embodiment, the bottom floor or wall of the container, which normally is made of a molded unitary plastic-like material, may include a designated area of increased flexibility that can be manually depressed with some movement to permit actuation of the plunger when the container is inverted. In this embodiment, the recessed area of the floor having an aperture for the plunger end tip is eliminated.

In still another alternate embodiment, the plunger end tip is heat fused on the inside bottom wall of the container in a specified area that has a circular depressible, flexible location in which the circular raised portion receives the end tip of the plunger. By heat fusing the end tip of the plunger shaft to the bottom container wall, the non-cutting areas on the head of the plunger can be removed since the plunger will not leave the container. In this embodiment the outside raised area of the container bottom is depressed and being flexible allows the raised portion to move inwardly a sufficient amount to move the plunger head thereby tearing the seal over the mouth of the container allowing the oil to be dispensed.

The container body may be made of any suitable liquid impervious material and is usually a heavy grade molded plastic.

To operate the invention, first the oil cap is removed from the opening in the valve cover on the engine into which oil is to be dispensed. The oil container cap is removed. The oil container may be inverted with the spout disposed within the oil inlet opening. At this point in time, the end tip of the plunger shaft is then depressed manually through the container bottom with a finger which causes the foil seal over the spout to tear in a substantially crescent-shape, permitting the oil in the container to pour freely into the engine. Once the container is empty, it can be easily removed and the cap replaced and the entire container with the actuating plunger disposed.

Although the invention is shown used for engine oil dispensing, the invention can also be used with other liquids in a suitable container for dispensing brake fluid or any other liquid that must be dispensed in very closed spaces without sufficient room for proper alignment and inversion of the dispensing container.

It is an object of this invention to provide an improved liquid dispensing container which permits inversion of the container and dispensing in very limited spaces without spillage.

It is another object of this invention to provide an improved oil dispensing container that has a self-contained dispensing plunger which permits dispensing after the container has been properly positioned with the container spout within the engine oil intake opening to prevent spillage.

And yet another object of this invention is to provide a non-complex, low cost oil container that includes a dispensing device to prevent spillage of the oil in limited space engine compartments.

In accordance with these and other objects which will be apparent hereinafter, the instant invention will now be described with particular reference to the accompanying drawings.

BRIEF DESCRIPTION OF THE DRAWINGS

FIG. 7 shows a front elevational view partially cut away showing yet another alternate embodiment of the invention in which the plunger is heat fused at its end tip to the base of the container.

FIG. 8 shows a cross sectional view through 8—8 of the embodiment shown in FIG. 7.

FIG. 9 is a bottom plan view partially cut away showing the actuating floor wall portion for actuating the plunger.

PREFERRED EMBODIMENT OF THE INVENTION

Figure 1:
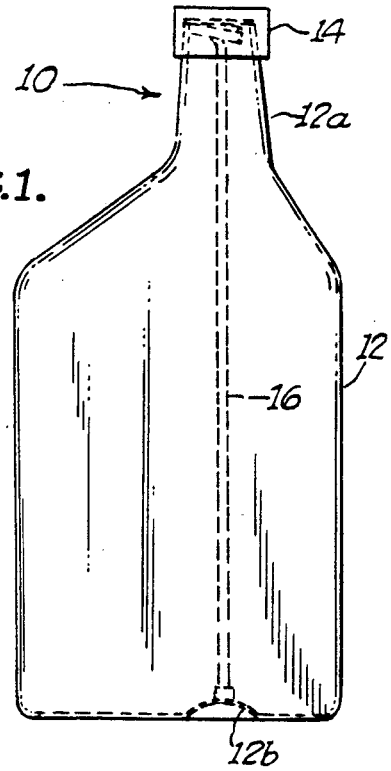
FIG. 1 is a front elevational view of the invention.

Referring now to the drawings, and in particular FIG. 1, the present invention is shown generally at 10 comprised of a liquid impervious container 12 useful for holding oil or other liquids, the container body 12 having a spout **12*a* and a recessed base portion 12*b*. Disposed within the container is a plunger 16. The conventional container cap 14 is mounted over spout 12*a***.

Figure 2:
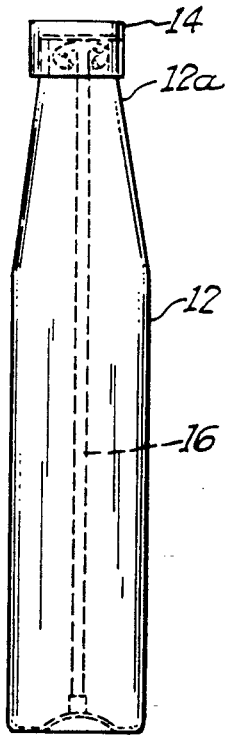
FIG. 2 is a side elevational view of the invention as shown in FIG. 1.

FIG. 2 shows an end view again showing the plunger 16 disposed within.

Figure 3:
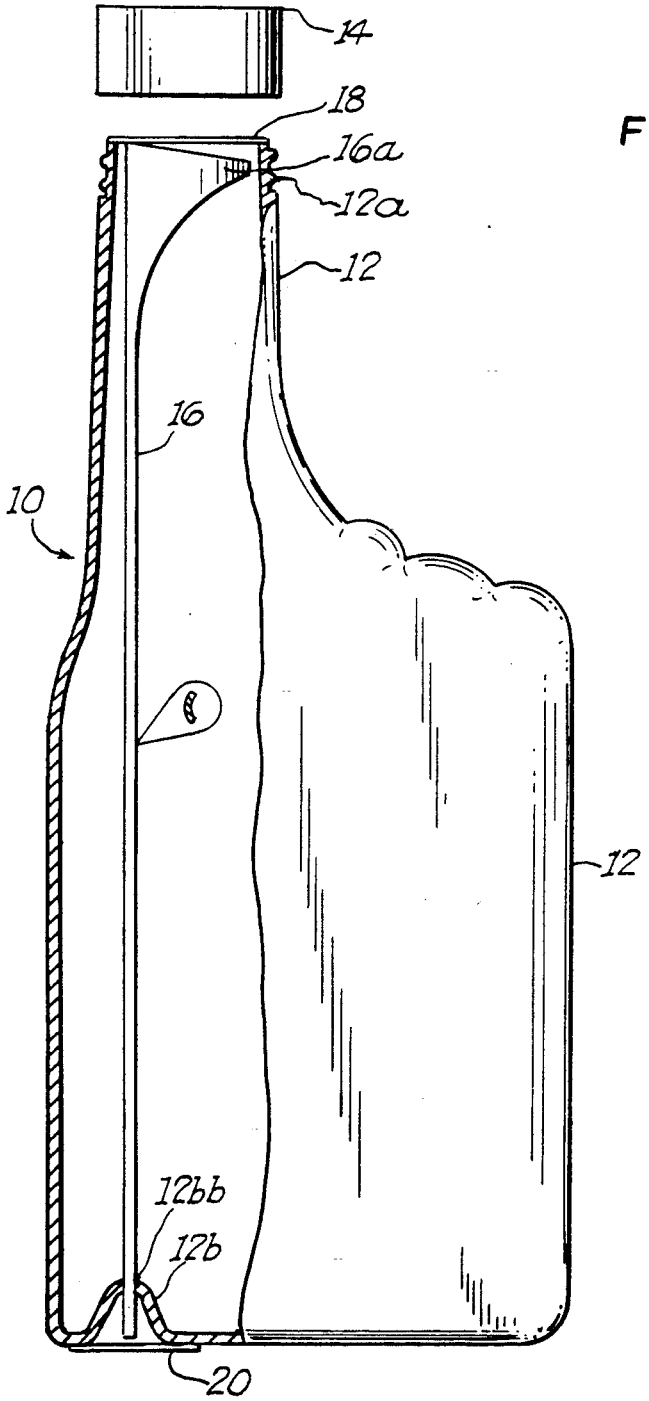
FIG. 3 is a front elevational view partly cut-away of the invention.

Referring now to FIG. 3, invention 10 also includes a frangible seal 18 disposed across the opening of spout **12*a* that prevents the liquid oil inside from spilling out of the container after the cap 14 is removed preparatory for dispensing the oil. The container 12 can be inverted with the seal 18** thereon and no liquid will leave the container.

The plunger 16 includes a cutting head **16*a* which is disposed relative to the shaft of plunger 16 so that the uppermost portion of the cutting head 16*a* can engage the frangible seal 18** at an initial single edge. This aids in the tearing and cutting action of the seal when the device is actuated.

The bottom wall **12*b* of container 12 includes a recessed portion through which the plunger 16 shaft is disposed in an aperture 12*bb* and the recessed portion 12*b*. In order to prevent oil from leaking from the container, a flexible seal 20 is mounted over the recessed portion 12*b* which allows for depression of plunger end tip 16** for actuating the device.

Figure 4A:
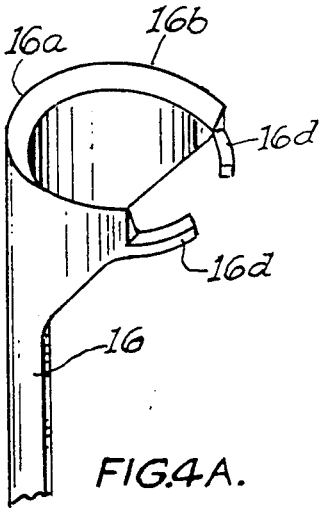
FIG. 4A shows the plunger cutting head used in the present invention in a perspective view.

FIG. 4A shows the upper portion of the plunger 16 and the cutting head **16*a* which includes a knife edge 16*b* along the upper portion of the cutting head. It is the knife edge 16*b* that will slice through the frangible seal 18 as shown in FIG. 3. The plane of the cutting head 16*a* may be at an angle less than 90 degrees from the shaft so that the center of the crescent shaped cutting head engages the frangible seal first. In this embodiment the cutting head includes projecting the retaining members 16*d* which do not cut the seal but which engage the portion of the seal that has not been cut to prevent the plunger from falling out of the container when the container 12 is in an inverted position while dispensing oil from the container. The retainer 16*d*** may be eliminated in another embodiment discussed below.

Figure 4C:
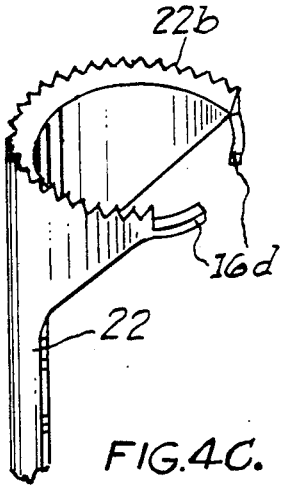
FIG. 4C shows an alternate embodiment of the plunger head as may be used in the invention in a side perspective view.
Figure 4B:
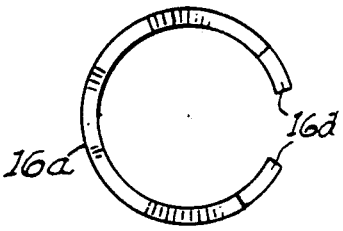
FIG. 4B shows a top plan view of the plunger head shown in FIG. 4A.

FIG. 4B shows the top plan view of the cutting head **16*a* which reveals that it is a partially circular or crescent-shaped of approximately 270 degrees which allows the foil seal to be ripped only in those areas exposed to the knife edge 16*b* on the cutting head 16*a*. Thus the seal 18** cannot fall into the engine opening since it will still be attached partially to the spout.

FIG. 4C shows an alternate embodiment of the plunger 22 which has a cutting head **22*a* and a serrated upper edge 22*b*** for cutting.

Figure 5A:
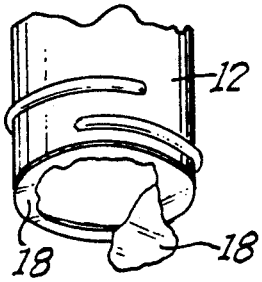
FIG. 5A shows the container spout seal in a perspective view with the container inverted after the seal has been destroyed and opened.
Figure 5:
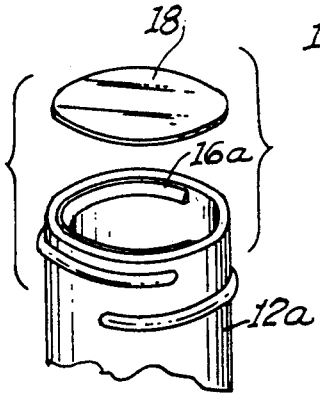
FIG. 5 shows an exploded perspective view of the container spout and spout seal as used in the present invention.

FIG. 5 shows the frangible foil seal 18 in an exploded view which is affixed and sealed by a suitable adhesive around the upper rim opening of spout **12*a*. The physical relationship of the cutting head 16*a*** is shown near the top of the spout in the sealed position.

FIG. 5A shows the condition of the seal 18 after the cutting head on the plunger 16 has been actuated. The uncut portion of the seal 18 prevents the torn portion of the seal 18 from falling into the engine oil compartment and also engages retainers **16*d* (see FIG. 4A) preventing the plunger 16** from leaving the container.

Figure 6A:
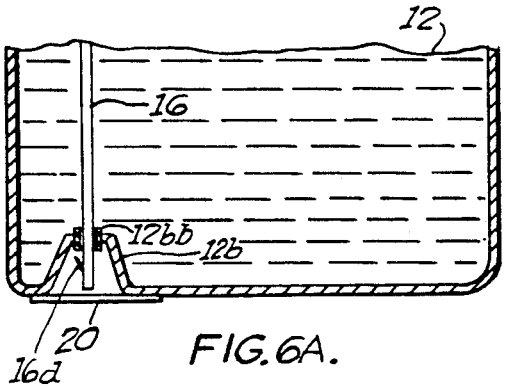
FIG. 6A shows a partially cut-away view of the container bottom and plunger actuating mechanism in a side elevational cross sectional view.
Figure 6B:
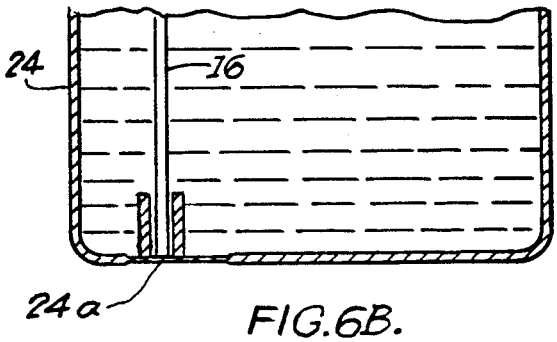
FIG. 6B shows the bottom portion of the container in a side cross sectional view partially cut-away of an alternate embodiment used for the plunger mechanism.
Figure 6:
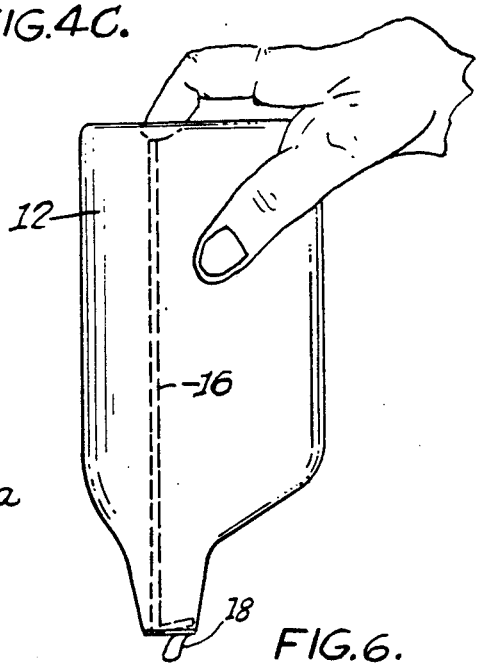
FIG. 6 shows a side elevational view of the container inverted as utilized in the present invention.

FIG. 6 shows the container 12 in an inverted position having been actuated by use of a finger that depresses against the end tip of rod 16 forcing the cutting head **16*a* against the frangible seal 18** forcing it to rip in a crescent-shape. The oil is then free to flow from the container. The container has been pre-positioned so the spout is in the oil inlet opening in the engine oil compartment thus preventing any spillage.

FIG. 6A shows the container 12 having a recessed bottom wall portion 12*b* and in the recessed portion 12*b* an aperture 12*bb* which receives a portion of the shaft of plunger 16. The fit between the aperture 12*bb* and the diameter of the shaft 16 is such that it is a snug fit to prevent excess oil from leaking into the recessed chamber but with sufficient space to prevent a liquid pressure lock when depressing the flexible sheet. However a sealing flexible sheet 20 is affixed to the base of the container 12 to ensure that the entire container is sealed. The flexible sheet 20 also permits actuation or pushing on the plunger 16 shaft end tip for actuating the device.

FIG. 6B shows an alternate embodiment of the container 24 having on its bottom wall, a thin resilient portion 24*a* which again can be used for flexibly depressing against the end tip of plunger 16. The flexible portion 24*a* of the bottom wall is achieved in the molding process by making the wall portion thinner than the surrounding wall of container 24. A support fixed to the thin resilient portion on the inside wall surrounding the shaft end tip prevents lateral movement of the shaft end tip.

Referring now to FIG. 7 an alternate embodiment which is the preferred embodiment of the invention is shown in which the invention 22 includes a container 24 similar to the one already described herein having a cutting plunger 26 with cutting head 26*b*. The end tip 26*a* of plunger 26 is heat fused to a predetermined recessed area 24*a* formed unitarily in the bottom floor of container 24. The recessed area 24*a* is defined by a circular ridge around the heat fused end tip 26*a* of the plunger which firmly holds it in place. In that the bottom floor of container 24 is somewhat flexible, the recessed area 24*a* may be depressed from the outside so that it extends to area 24*b* which is a sufficient distance to allow the plunger head 26*b* to tear the seal across the top of the container allowing the oil to be dispensed when the container 24 is in an inverted position.

FIG. 8 shows the location of the shaft 26 of the plunger in a recessed area that is defined by a raised portion 24*b* inside the container.

In FIG. 9 the recessed portion 24*a* is shown surrounded by a depressed area 24*b* defining the actuating mechanism for the container.

Although the invention has been shown for use as an oil container to prevent oil spillage in an engine compartment, other fluids can be used in the container for dispensing in likewise closed or limited space areas where spillage is not desirable.

The instant invention has been shown and described herein in what it is considered to be the most practical and preferred embodiment. It is recognized, however, that departures may be made therefrom within the scope of the invention and that obvious modifications will occur to a person skilled in the art.

What I claim is:

1. A container for dispensing a liquid therein in an inverted position comprising:

a hollow liquid impervious receptacle having a spout with an opening at one end and a base wall at the other end;

a frangible liquid impervious seal affixed over said spout opening;

a substantially straight, rigid, elongated plunger shaft having a first end and a second end, said shaft disposed within said receptacle and extending from said spout seal at its first end to said receptacle base wall at its second end, said base wall including a recessed portion for retaining said shaft second end from moving in the plane of said base wall; and seal-cutting means attached to said plunger shaft first end for tearing said seal and means for retaining said shaft in said receptacle connected to said seal cutting means.

2. The liquid container as in claim 1 wherein:

said seal cutting means is crescent-shaped;

3. The liquid container as in claim 2 wherein:

said receptacle base wall is recessed and includes an aperture for receiving a portion of said plunger shaft second end; and second sealing means are disposed over said receptacle recessed area.

4. The liquid container as in claim 2 wherein:

said receptacle has a predetermined flexible area formed in said base wall adjacent said plunger shaft for manually actuating said plunger shaft when external pressure is applied to said flexible area whereby said plunger shaft and cutting means are driven normal to said receptacle base wall and said cutting means tear said seal when actuating and dispensing a liquid from said receptacle in an inverted position.

5. A container for dispensing liquid therein in an inverted position comprising:

a hollow liquid impervious receptacle having a spout with an opening at one end and a base wall at the other end;

a frangible liquid impervious seal affixed over said spout opening;

a substantially straight elongated plunger shaft having a first end and a second end, said shaft disposed within said receptacle and extending from said spout seal at its first end to said receptacle base wall at its second end, said plunger shaft connected to said receptacle at said second end; and seal cutting means attached to said plunger shaft first end for tearing said seal; and means for retaining said shaft in said receptacle connected to said seal cutting means.

6. A liquid container as in claim 5, wherein said receptacle base wall has a recessed wall portion for engaging said plunger shaft; said plunger shaft being attached within said recessed base wall portion and movable to permit movement of said plunger shaft and cutting means for tearing said seal when actuating and dispensing a liquid from the container in a inverted position.

* * * * *